United States Patent [19]

Behrens

[11] Patent Number: 4,694,900

[45] Date of Patent: Sep. 22, 1987

[54] DRY PELLET DISPENSING DEVICE FOR WELLS

[75] Inventor: Kelly D. Behrens, Albert City, Iowa

[73] Assignee: B & B Chlorination, Albert City, Iowa

[21] Appl. No.: 763,038

[22] Filed: Aug. 5, 1985

[51] Int. Cl.[4] ..... E21B 43/25

[52] U.S. Cl. ..... 166/75.1; 137/268

[58] Field of Search ..... 221/266, 277; 422/263, 422/264, 266; 166/75.1; 137/268

[56] References Cited

U.S. PATENT DOCUMENTS

| | | | |
|---|---|---|---|
| 3,248,008 | 4/1966 | Meierjohan | 221/277 |
| 3,680,736 | 8/1972 | Viessmann | 221/266 |
| 4,235,849 | 11/1980 | Handeland | 166/75.1 X |

*Primary Examiner*—Stephen J. Novosad
*Assistant Examiner*—Thomas J. Odar
*Attorney, Agent, or Firm*—Kent A. Herink; G. Brian Pingel

[57] ABSTRACT

A dry pellet dispensing device for installation on a well to chemically treat water drawn from the well. The device includes a pellet reservoir having two reversely inclined floor portions which direct the pellets toward a metering drum. The metering drum is mounted for rotation at an outlet end of the lower of the two floor portions. A plurality of pellet receiving indentations are spaced along the periphery of the metering drum. A drive motor rotates the drum which acts to capture a pellet in each of its pellet receiving indentations. Captured pellets are carried out of the pellet reservoir by the drum and released into a dispensing tube which directs them into the well. The drive motor is controlled by an adjustable interval timer that is responsive to the flow of water from the well. Capture efficiency of the pellet receiving indentations is enhanced by a circumferential indentation centered with respect to the pellet receiving indentations, and by a pair of elongated indentations associated with each pellet receiving indentation on either side of the circumferential indentation and flaring outwardly in a generally V-shape in the direction of rotation of the drum.

10 Claims, 4 Drawing Figures

FIG. 4
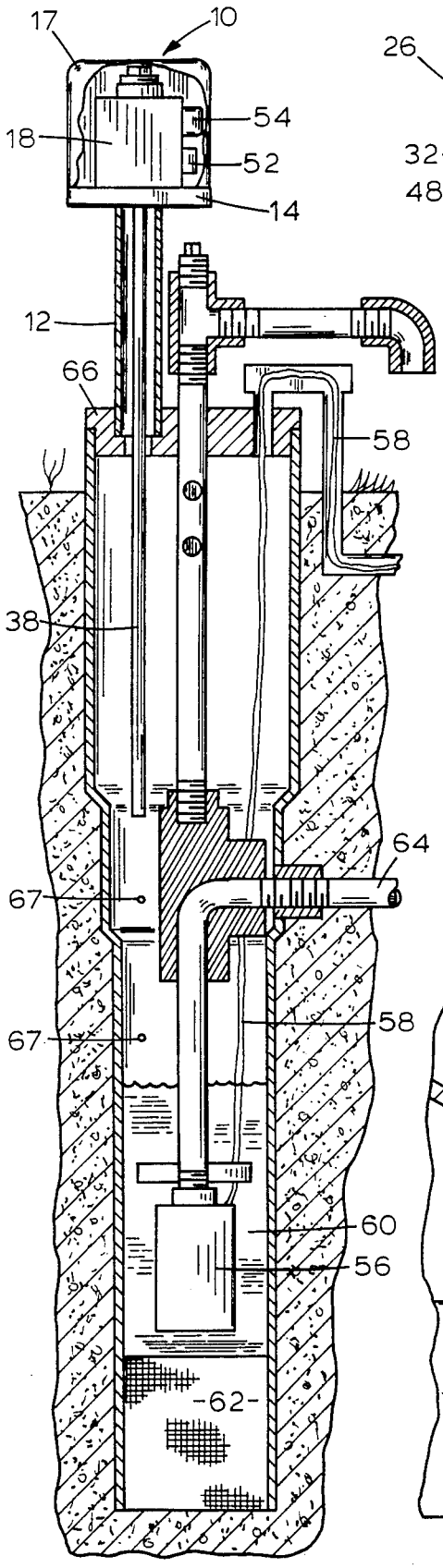
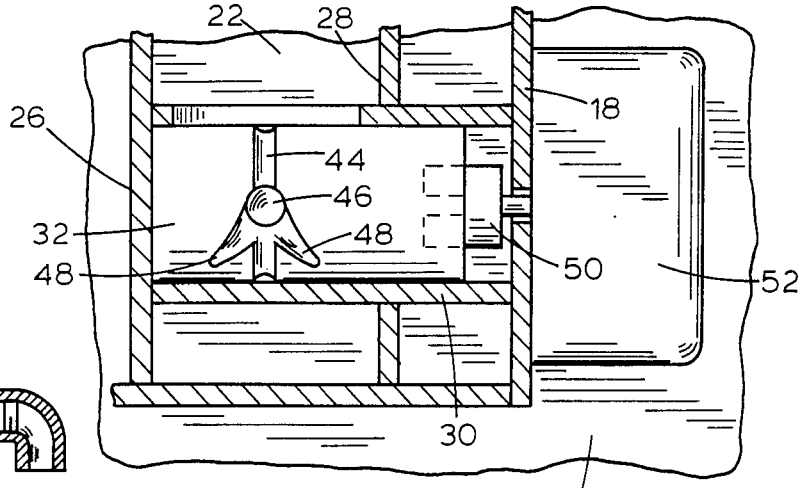
FIG. 2
FIG. 3
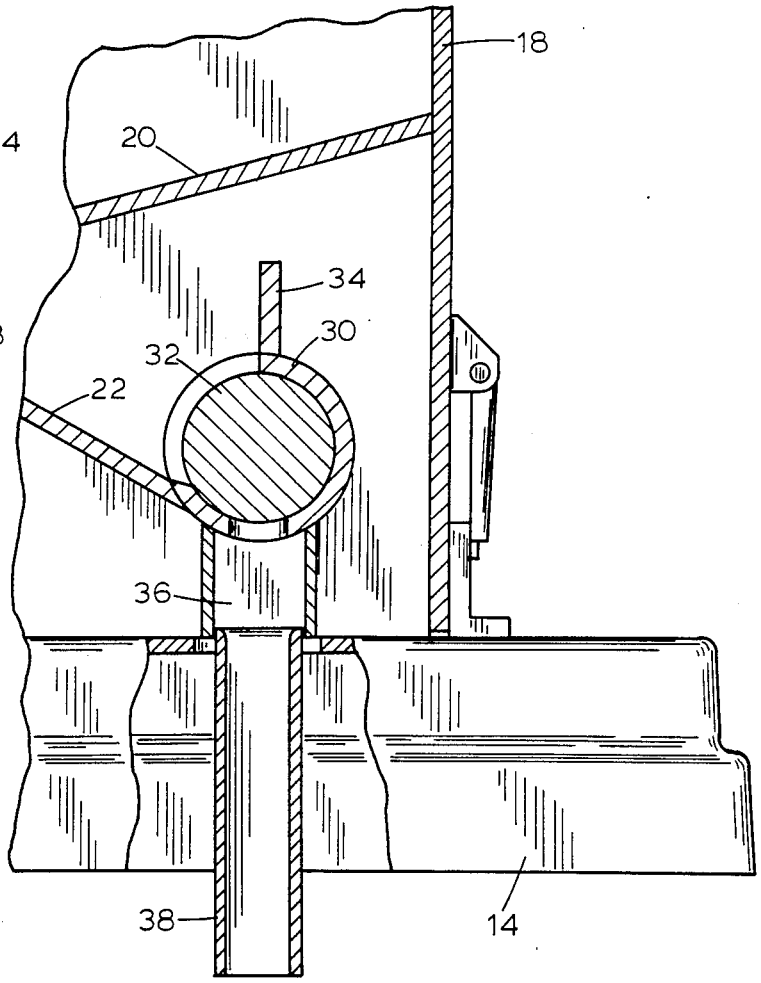

DRY PELLET DISPENSING DEVICE FOR WELLS

BACKGROUND OF THE INVENTION

The invention is directed generally to dry pellet dispensing devices and, more particularly, to a device for dispensing dry chemical pellets for the treatment of water pumped from a well.

There are many homes and farms which rely on private wells as the sole source of water for both people and animals. Not infrequently, the wells are contaminated with undesirable bacteria and other microorganisms. Some, such as red rust or iron bacteria, are merely a nuisance, causing the water to be unsuitable for washing clothes and resulting in excessive mineral deposits in pipes through which the water flows. Other organisms transmit water-borne diseases that infect both people and livestock ingesting the water. Careful treatment of the water with the appropriate chemicals can frequently alleviate the most typically found contaminations.

Devices for treating wells with chemicals are known. Examples include U.S. Pat. Nos. 3,785,525 and 4,235,849. Both patented devices rely on rotating plates to meter the dispensing of solid pellets from a supply resevoir into the well. The known devices suffer from several problems. One problem is the difficulty of metering precisely and adjustably the amount of chemical dispensed into the well. The chemical pellets are subject to breakage, and pieces of the pellets can jam the metering or delivery parts of the known devices. Satisfactory performance of the devices also depends on the reliability of the metering parts to select a single pellet each dispensing cycle. As a result, either over- or under-treatment of the water can occur.

SUMMARY OF THE INVENTION

The dry pellet dispensing device of the present invention includes a pellet supply reservoir divided by a pair of reversely inclined partitions. A metering drum is located at the outlet of the lower partition. The periphery of the drum contains one or more pellet receiving indentations. Each indentation consists of a central, substantially cylindrical well the axis of which is aligned with a radius of the drum. Flared outwardly from each pellet receiving indentation is a pair of indentations forming a generally V-shape with a vertex at the pellet receiving indentation.

The metering drum is rotated by motor drive means. The drive means is controlled by an adjustable timer which can be set to run the motor any desired portion of the amount of time water is being pumped from the well. As the metering drum rotates, a single pellet is received in the central well of one of the indentations. The flared indentations, the legs of which flare outwardly and forwardly in the direction of rotation of the drum, assist in the capture of a pellet in the pellet receiving indentation. A captured pellet is carried by the rotating drum until the carrying indentation is at the bottom of the drum. Gravity causes the pellet to be released into a pellet discharge tube which directs it into the reservoir of water to be pumped from the well.

BRIEF DESCRIPTION OF THE DRAWINGS

FIG. 2 is a partially sectional plan view of the metering drum and drive motor;

FIG. 3 is a sectional elevational view of the metering drum and pellet discharge tube; and FIG. 4 is a sectional view of the dry pellet dispensing device installed on a well.

DETAILED DESCRIPTION OF A PREFERRED EMBODIMENT

Figure 1:
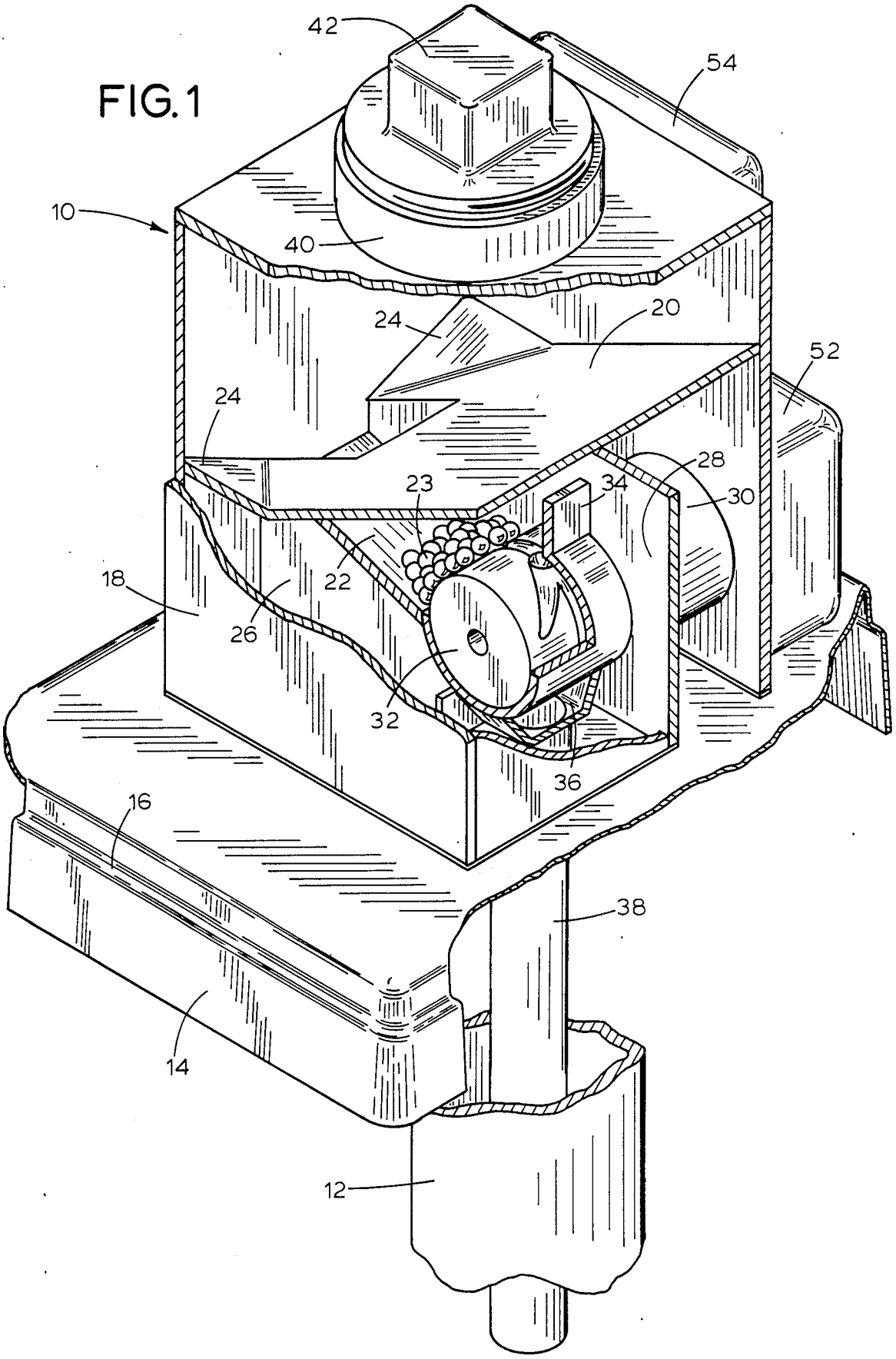
FIG. 1 is a partially sectional perspective view of the dry pellet dispensing device of the present invention.

A dry pellet dispensing device of the present invention is illustrated in FIG. 1 generally at 10. The pellet dispensing device 10 is shown mounted on a ground support post 12, which illustrated only in part in FIG. 1. Mounted on post 12 is a base 14 which includes an enlarged rim at 16 to engage a cover (17 in FIG. 4) as will be described in detail below. The base 14 supports a pellet reservoir or chamber 18 which is subdivided into several smaller volumes. The upper portion of the chamber 18 is partially divided by a pair of reversely inclined floor portions, upper floor portion 20 and lower floor portion 22. Pellets 23 for dispensing by the device 10 are introduced into the chamber 18 through the raised collar 40 which is ordinarily sealed shut with a threaded plug 42. The floor portions 20 and 22 are positioned to direct by gravity pellets 23 in the upper portion of the chamber 18 down toward the lower end of floor portion 22. The pair of lower corners 24 of floor portion 20 are accordingly inclined toward lower floor portion 22 below the opening in upper floor portion 20.

Narrowing the lower floor portion 22 are a pair of interior side walls 26 and 28 which extend across the chamber 18 from the base 14 upwardly to the upper floor portion 20. Interior side walls 26 and 28 receive a cylindrical sleeve 30 which also extends to the exterior of the chamber 18. Received for rotation within sleeve 30 is a metering drum 32. The drum 32 is exposed through the sleeve 30 in two areas, as is most clearly shown in FIG. 3. The first area is between the top of the sleeve 32, where a portion 34 extends upwardly to a point above the opening in the upper floor portion 20, to where the drum 32 is adjacent the lower floor portion 22. The second area is a full-width slot at the bottom of the sleeve 30 where the drum 32 is exposed to a lower chamber 36 the walls of which extend from the sleeve 30 downwardly to the base 14 wholly enclosing the second enclosed area. Pieces of broken pellets and fines picked up by the drum 32 are, accordingly, discharged through the full-width slot. Communicating from the lower chamber 36 and to outside the base 14 is a pellet receiving tube 38. All parts of the device 10 which may be exposed to the pellets 23 or their released gasses should be made of a material resistant to the strong oxidizing effects typically exhibited by the pellets.

Referring now to FIG. 2, the metering drum 32 has a plurality of indentations about its circumferential periphery. One is a circumferential ring 44 of a shallow concave cross-section and roughly centered with respect to the lower floor portion 22. Spaced about the ring 44 is one or more pellet receiving indentations 46 of a size to receive a single pellet such that the captured pellet will not extend past the radial confines of the drum 32. Also included are a pair of outwardly flaring identations 48 which form a generally V-shape as best shown in FIG. 2. The indentations 48 deepen, as will be described in more detail below, from the outer end thereof to where they meet the pellet receiving indentation 46.

Operatively connected to the drum 32 is drive shaft 50 which, in turn, is rotated by motor 52. Operation of the motor 52 thereby rotates the drum 32 within sleeve 30. The motor 52 in a preferred embodiment is a 1/250 horsepower electric gear reduction motor that turns at one revolution per minute when connected to 120 volt, 60 HZ. current. The 1/250 horsepower gear reduction motor used as motor 52 is sufficiently powerful to shear the calcium hypochlorite pellets described above. Accidental lodging or a pellet of a broken piece of a pellet, therefore, does not cause a malfunction of the device. Electrical power to the motor 52 is controlled by an interval timer 54 (FIG. 1) which, in turn, is supplied with power and runs only during the time water is being pumped from a well on which the device 10 has been installed. The interval timer 54 can be set to operate the motor 52 any proportion of the time that water is pumped from the well.

The device 10 is shown installed on a well in FIG. 4. The well includes an electrical submersible pump 56 connected to a power source by supply line 58. Of course, any other pump means, such as a jerk rod pump, could be used in place of the submersible pump 56. The pump 56 is submersed below the surface of an underground source of water 60 and above a filter screen 62. Water pumped from the well is routed through discharge tube 64. A well cover 66 covers the top opening of the well and mounts support post 12 for support of the device 10. Surrounding the pellet reservoir 18, motor 52 and timer 54 is the cover 17 which seals around the base 14 to keep environmental water and moisture out of the device 10. Pellet dispensing tube 38 passes inside support post 12 and into the well. Dispensed pellets 67 are dropped from the tube 38 into the water 60. Dissolving pellets may reside on filter screen 62.

In operation, an electrical pressure switch on a pressurized supply tank attached to the discharge tube 64 actuates the pump 56 to refill the supply tank whenever the pressure therein drops below a predetermined pressure. The pressure switch controlling pump 56 also actuates the interval timer 54 so that timer 54 runs whenever pump 56 is pumping water from the well. Timer 56, accordingly, operates to measure the volume of flow of water from the well. For human consumption, a ratio of between 0.5 and 1.0 part per million of residual chlorine to water is found to produce the desired bacteriostatic effect without imparting an adverse taste or odor to the discharge water. The level of residual chlorine in water pumped from the well is dependent on the volume of water in the well, the flow of water pumped from the well, the temperature of water in the well, and the degree and type of contamination present.

The residual chlorine level in water pumped from the well can be adjusted by appropriately changing the number of chlorine pellets 67 dispensed into the well by the device. This may be accomplished in two ways. First, the interval timer 54 can be adjusted to operate the motor 52 either a larger or smaller proportion of the time water is being pumped from the well. Secondly, the number of pellets dispensed per revolution of the motor 52 and metering drum 32 can be adjusted by increasing or decreasing the number of pellet receiving indentations 46 in the periphery of the drum 32.

The pellets dispensed by the device 10 of the preferred embodiment are oblate spheriods having a minor diameter of 5/16 inches (7.9 mm) and a major diamter of ⅜ inches (9.5 mm). The pellets are compressed out of 70% calcium hypochlorite ($Ca(C10)_2 \cdot 2Ca(OH)_2$) and 30% inert soluble material, and weigh 0.035 oz. (1 gram). It has been determined that one such pellet dissolved in 10 gallons of water will result in a residual chlorine level of approximately 0.5 to 1.0 parts per million. With six pellet receiving indentations in the drum, and the timer set to operate continuously with the pump, a continuous flow rate of 60–70 gallons per minute can be treated by the dispenser.

The pellet receiving indentations 46 of the drum 32, as described above, are of a size to capture a single pellet. The motor 52 rotates the drum 32 so that the surface of the drum 32 adjacent the lower floor portion 22 moves upwardly with respect thereto. The circumferential indentation 44 is centered with the pellet receiving indentations 46. It acts during rotation of the drum 32 to center a pellet in line with the next pellet receiving indentation 46. Also assisting the capture of a pellet are the two flared indentations 48. A pellet off center of the circumferential indentation 44 will be urged toward the pellet receiving indentation 46 by the two flared indentations 48 as they are rotated through the pellets ahead of the pellet receiving indentation. In dispensing pellets the size and type described above, it has been found that the following dimensions of the indentations enhance single pellet capture in the pellet receiving indentation 46:

(a) Circumferential indentation 44
  width 9 mm
  maximum depth 2 mm
(b) Flared indentations 48
  length 18 mm
  maximum width 8 mm
  maximum depth 3 mm
(c) pellet receiving indentation 46
  diameter (edges chamfered) 12 mm
  depth 12 mm It should be clear from the foregoing description of the preferred embodiment that other mechanical or electrical means could be employed in accomplishing the broad purposes of the invention. It should be understood this description is intended to illustrate but not to limit the scope of the invention as defined in the following claims.

I claim:

1. Apparatus for dispensing dry pellets, comprising:
(a) a pellet reservoir having a pair of oppositely inclined floor portions and a lower chamber;
(b) tube means downwardly communicating between said lower chamber and the outside of the pellet dispensing apparatus;
(c) a metering drum mounted for rotation inside a cylindrical sleeve near an outlet end of the lower of said floor portions, and separating the upper side of said lower floor portion from said lower chamber;
(d) one or more indentations, substantially circular in cross section, in the periphery of said drum for receiving a single pellet;
(e) drive means for rotating said metering drum from a first position wherein one of said indentations receives a pellet from said pellet reservoir to a second position wherein said pellet is delivered into said tube means; and
(f) responsive control means for selectively operating said drive means to deliver pellets at a predetermined adjustable rate.

2. The apparatus defined in claim 1, further comprising:

(a) a generally V-shaped indentation which flares outwardly from each of said pellet receiving indentations in the direction of the rotation of said drum.

3. The apparatus defined in claim 2, wherein:

(a) each leg of said generally V-shaped indentation deepens gradually from the outer end thereof to the inner end thereof at a pellet receiving indentation.

4. A dry pellet dispensing apparatus installed on a well, comprising:

(a) a pellet chamber having a pair of oppositely inclined floor portions and a lower chamber portion;

(b) tube means which communicates from said lower chamber portion downwardly to the well;

(c) a metering drum mounted for rotation inside a cylindrical sleeve adjacent the lower edge of the lower of said inclined floor portions, and partially defining said lower chamber;

(d) one or more indentations, substantially circular in cross section, in the periphery of said drum for receiving a single pellet;

(e) drive means for rotating said drum between a first position wherein a single pellet is received in one of said indentations and a second position wherein said pellet is delivered into said tube means;

(f) adjustable control means for selectively operating said drive means in direct response to usage of the well.

5. The apparatus defined in claim 4, further comprising:

(a) pump means for forcing water from the well; and wherein, (b) said adjustable control means operates said drive means a predetermined portion of the time said pump means is forcing water from the well.

6. The apparatus defined in claim 4 wherein:

(a) said control means includes a timed switch that powers the drive means a preselected portion of time water is being pumped from the well.

7. The apparatus defined in claim 4, further comprising:

(a) a generally V-shaped indentation which flares outwardly from each of said pellet receiving indentations in the direction of the rotation of said drum.

8. The apparatus defined in claim 7, wherein:

(a) each leg of said generally v-shaped indentation deepens gradually from the outer end thereof to the inner end thereof at a pellet receiving indentation.

9. The apparatus defined in claim 1, wherein:

(a) said dry pellets are sturdy but somewhat friable.

10. The apparatus as defined in claim 1, wherein:

(a) said dry pellets are prolate.

* * * * *